United States Patent [19]

Henricks et al.

[11] 4,093,523

[45] June 6, 1978

[54] BRIGHT ACID ZINC ELECTROPLATING BATHS

[75] Inventors: John A. Henricks, Oak Park; Robert E. Wild, Wheaton, both of Ill.

[73] Assignee: Edward B. Wild, Wheaton, Ill.

[21] Appl. No.: 766,554

[22] Filed: Feb. 7, 1977

[51] Int. Cl.[2] ..... C25D 3/22

[52] U.S. Cl. ..... 204/55 R; 204/DIG. 2; 252/182

[58] Field of Search ..... 204/55 R, 55 Y, DIG. 2, 204/114, 43 Z, 123; 252/182

[56] References Cited

U.S. PATENT DOCUMENTS

| | | | |
|---|---|---|---|
| 3,729,394 | 4/1973 | Hsu et al. | 204/55 R |
| 3,730,855 | 5/1973 | Poor et al. | 204/55 R |
| 3,787,297 | 1/1974 | Beckwith et al. | 204/55 R |
| 3,928,149 | 12/1975 | Steeg | 204/55 R |
| 3,974,045 | 8/1976 | Takahashi et al. | 204/55 R |
| 4,007,098 | 2/1977 | Rosenberg | 204/55 R |

*Primary Examiner*—G. L. Kaplan

[57] ABSTRACT

This invention is directed to a brightening system for zinc deposited from an acid zinc chloride electrolyte containing potassium chloride as a conducting salt and boric acid as a buffer. The active brightener in the system is an aromatic aldehyde or ketone which is dispersed into the electrolyte by a wetting agent system consisting essentially of a mixture of a fatty acid imidiazole sulfonate and a fatty diaminobetaine carboxylate; assisted by a hydrotrope selected from the group consisting of alcohol ethers, cyclic alcohols, and aromatic sulfonates. In some cases, this brightening system can be augmented by the prior art nicotinic acid, or polyamine zinc brightener.

8 Claims, No Drawings

BRIGHT ACID ZINC ELECTROPLATING BATHS

BACKGROUND OF THE INVENTION

This invention is directed to an "improvement" in the art of acid zinc chloride plating baths. The zinc chloride electrolytes have been replacing the old alkaline zinc cyanide electrolytes in order to eliminate the toxic effluents from the cyanide baths. An additional advantage is that the zinc chloride baths will plate over carbonitrided steel parts that are difficult to impossible to plate in an alkaline zinc bath.

The pioneer bright zinc chloride electroplating baths were those of Korpium and Steeg disclosed in U.S. Pat. No. 3,694,330 of Sept. 26, 1972. These inventors utilized an electrolyte of zinc and ammonium chlorides, along with a complexing agent selected from the group consisting of glycero-phosphates, triethanolamine, ethylene diamine, and ethylene diamine tetracetic acid. For a brightening system; they utilized an aromatic carbonyl compound dispersed by means of an ethoxylated surfactant selected from the ethylene oxide condensation products with long chain fatty alcohols, fatty acids, or fatty amines, or with long chain alkyl phenols.

Variations of this original bright zinc chloride bath were made by utilizing other brightening agents as substitutes for the aromatic carbonyl compound, but continuing the use of the polyoxyethylated wetting agents. For example Rosenberg in U.S. Pat. No. 3,767,540 used polyimines with a polyoxyethylated napthol wetter, and Creutz in U.S. Pat. No. 3,909,373 used ethoxylated acetylenic glycol wetters along with isopropyl nicotinate. A departure from the use of the polyoxethylated wetting agents alone came from Beckwith and Hsu in U.S. Pat. No. 3,787,297 who introducted the use of a fatty sarcosine in conjunction with a fatty imidazoline and an ethoxylated carbamine sulfonate to disperse the aromatic carbonyl brighteners. The ethoxylated carbamine sulfonate wetter is used at twice the concentration of the other wetting agents in this system.

SUMMARY OF THE INVENTION

The best electrolyte to minimize effluent contamination is the zinc chloride bath using potassium chloride as the conducting salt and boric acid as the buffer. This type bath was selected for this process. We also utilize the aromatic aldehyde and ketone brighteners that have had a long time use in both the alkaline and acid bright zinc plating baths.

The novelty of this invention lies in the choice of a dispersing system for the prior art aromatic aldehydes and Ketones. We have found that certain carboxylated or sulfonated fatty acid diamine wetting agents produced very bright zinc deposits over a wide range of current densities when they are used to disperse the aromatic aldehydes and ketones; especially when the system is stabilized with a suitable hydrotrope.

The fatty acids that impart surface activity to these compounds can range from 8 to 18 carbons and the diamine component can be either a straight chain diamine or an imidazole structure. In all cases, one of the two amine nitrogens must be quaternary and the compound must be made amphoteric by a carboxyl or a sulfonic acid group. Every such compound has a specific current density range. The fatty diamine betaines function at low and intermediate current densities, while the fatty imidazole sulfonates function at the higher current densities. Typical fatty diamino betaines are Tomah Chemicals Amphoteric L and Armstrong Chemicals' Accobetaine. Both products are derived from the condensation of amino propyl dimethyl amine with cocoanut fatty acids, followed by carboxylation with chloracetic acid or acrylic acid. The sulfonated fatty acid imidazoles are of two types- the aromatic benzimidazoles that are sulfonated in the benzene ring portion, and the fatty imidazoles that are sulfonated through the quaternary ring nitrogen by means of propane sultone or by 1 chloro-2hydroxy - 3 propane sulfonic acid. Typical sulfonated fatty imidazolines are the Miranol JS from octoic acid, Miranol CS from cocoanut fatty acids, and Miranol OS from oleic acid. U.S. Pat. No. 2,154,922 shows a method of making fatty imidazoline sulfonates.

Typical fatty imidazoline sulfonates are Ultravon WCA and Ciba-Geigy and Intravon WCA from Crompton-Knowles. These materials are made by the condensation of orthophenylene diamine with stearic acid to form the fatty benzimiazole which is first quaternized and then sulfonated. The methods of making these wetting agents is disclosed in U.S. Pat. Nos. 2,170,474 and 2,297,760 to Graenacher et al.

When these amphoteric wetting agents are substituted for the prior art ethoxylated nonionic wetting agents, a problem is created.

The problem in the use of these amphoterics in a zinc plating bath lies in their ionic nature. These materials act as a base in acid solution and as an acid in basic solution; but they have an iso-electric point in-between at which they form an inner salt which has a decreased solubility.

In the electrolysis of aqueous solutions, hydrogen ions are discharged at the cathode to leave behind residual hydroxyl ions that raise the pH of the cathode film. The film pH increase is proportional to the current density so that the cathode film pH is high at points of high current density and low at points of low current density. We thus have a varying cathode film pH throughout the whole current density range. At some critical film pH, the wetting agent micelle can lose solubility and become unstable, to lose its effectiveness in the cathode film. When the amphoteric micelle loses solubility and effectiveness, the zinc deposit becomes streaked and irregular. We have found that we can stabilize the amphoteric wetting agents against their loss of solubility and effectiveness by the use of hydrotropes in the zinc plating bath. We have found that all of the common hydrotropes are effective; and have had success by the use of aromatic sulfonic acids, glycol ethers, and cyclic alcohols. These hydrotropes all stabilze the amphoterics so that the streaking phenomena is eliminated and a full range bright zinc deposit can be obtained throughout the entire plating current density range of the zinc chloride bath. The selection and characterization of these chemically different hydrotropes is discussed in more detail below.

DESCRIPTION OF THE INVENTION

We have found the following zinc plating bath to be the most satisfactory for our purpose.

| | | | |
|---|---|---|---|
| Zinc Chloride | $ZnCl_2$ | 0.5 Molar | 69 g/l |
| Potassium Chloride | KCl | 1.5 Molar | 225 g/l |
| Boric Acid | $H_3BO_3$ | 0.5 Molar | 30 g/l |
| ph | 5.2 to 5.5 | | |
| Temperature | 60 F to 85 F | | |

The plating bath should be free of impurities and high purity chemicals should be used for maintenance. The bath should be treated with zinc dust to remove heavy metals and filtered before use. The bath should be filtered during use, and the iron that is picked up by the plating of ferrous articles should be removed periodically.

The performance of the various addition agents is best illustrated by the use of the standard 267 ml. Hull Cell. For example, when the above zinc bath is used in a Hull cell drawing a total of two amperes, the range of cathode current density runs from about 1 amp./sq.ft. at the far end up to about 100 amps./sq.ft at the end close to the anode. The deposit obtained from this plain bath is badly burned at the anode end, but is coated with a silvery white crystalline coating of zinc which is thin and spotty at the low current end of the Hull panel. When 2 g/l of benzaldehyde is added to this plain zinc chloride bath, and another Hull cell panel plated at a total current of 2 amperes for five minutes; there is a bright band from the 25 amp./sq.ft. area up to the 45 amp./sq.ft. area, but which is marred by small craters caused by the adsorption of the sparingly soluble oily aldehyde into the deposit. When 7 g/l of Tomah Chemical Co. Amphoteric L (a lauryl amido propyl dimethyl-amino acetic acid) is added to the benzaldehyde containing zinc chloride bath, and another Hull cell panel plated at 2 amperes for five minutes, it was found that the bright plate range was spread from 15 amp/sq.ft. area up to the 65 amp./sq.ft. area, and that the previous small craters were removed by the dispersion of the sparingly soluble benzaldehyde. When 2 g/l of Ultravon WCA, a stearyl benzimidazole sulfonate was added to the bath containing both the benzaldehyde and the Amphoteric L and the identical Hull cell test repeated; it was found that the whole Hull cell panel was bright from 1 amp/sq.ft. area up to the 100 amp./sq.ft. area, although there were some dull streaks in the high current density area. However, when 12 g/l of potassium xylene sulfonate was added to this same bath containing benzaldehyde and the two amphoteric wetters and the same Hull cell test repeated, all of the streaking was removed from the deposit and the lustre of the zinc deposit was enhanced through-out the whole current density range. The whole panel was brilliant and uniform.

While the amphoteric wetting agents of this invention are not zinc brighteners in themselves; they do have a profound effect upon the deposited zinc structure. Instead of the silvery white crystalline coating from the bath without addition agents, the amphoterics produce a gray finely divided non-crystalline zinc deposit. This cathode interferance is believed to contribute to the spread of the bright range of the aromatic aldehyde over a wider area, and that the improvement is not due to better dispersion of the sparingly soluble aldehyde alone. The fatty diamino surfactants should be considered to be auxiliary zinc brighteners as well as carriers for the aromatic aldehydes and ketones.

The performance of the various aromatic carbonyl brighteners, the action of the sulfonated fatty imidazoles and the fatty diamino betaines, and the function of the various hydrotropes to hold the system in solution is illustrated in the following examples.

We have found a simple test to evaluate the hydrotropes.. To simulate the high concentration of the amphoterics which migrate to the cathode where they are present at a higher concentration than in the bath, we made up a stock solution of 1.0 normal Zinc Chloride solution containing 5 g/l Benzaldehyde, 5 g/l Ultravon WCA and 20 g/l Amphoteric L. This stock solution had twice the addition agent concentration of the bath optimum and had a turbid milky color from undispersed addition agents. 100 ml samples of this cloudy stock solution was used to test the value of various hydrotropes, and the results tabulated in Table 1.

Table 1

Amount of Hydrotrope required to clear a 100 ml. sample of 1.0 normal Zinc chloride with 5 g/l Benzaldehyde, 5 g/l Ultravon WCA and 20 g/l of Amphoteric L.

| Hydrotrope | Amt. |
|---|---|
| 1- 40% solution of Methyl Naphthalene Sulf. (Petro A) | 9 ml. |
| 2- 40% solution of Toluene Sulfonate (Sodium) | 16 ml. |
| 3- 40% solution of Potassium Xylene Sulfonate | 6 ml. |
| 4- Dipropylene Glycol methyl ether (Dow DPM) | 16 ml. |
| 5- Butyl Ether of diethylene glycol (Dow EB) | 12 ml. |
| 6- Tetrehydropyran-2 methanol | 12 ml. |
| 7- Tetrahydrofurfuryl alcohol | 20 ml. |
| 8- Cyclohexanol | 18 ml. |

Table 1 is a guide to the selection of a hydrotrope that is best suited to use to elimate the precipitation of the amphoterics in the cathode film. The aromatic sulfonates are the group of first choice because they are cheaper and effective at a lower concentration. The cyclic alcohols and glycol ethers are equally effective; but have some loss due to their volatility and some unwanted softening action on Lucite or other plastics used in some plating equipment.

It should be noted that the fatty diamino carboxylate wetting agents have a very specific nature in their action in producing uniform brightness in the aromatic carbonyl bright zinc chloride bath. If we substitute different but similar fatty amido wetting agents for the lauryl amidopropyl dimethyl amino acetic acid, the zinc plate is streaked and irregular. For example Lonza Amphoterge K is a lauryl polyamide made by condensing lauryl chloride with a polypeptide, but fails when substituted for the lauryl amido propyl dimethyl amino acetate. Likewise, Lonza Betaine C, a lauryl betaine with only one nitrogen, is also unsatisfactory.

DESCRIPTION OF THE PREFERRED EMBODIMENTS

A series of plating tests were made in order to evaluate the four distinct types of addition agents that cooperate to produce a uniform bright zinc deposit from the acid zinc chloride plating bath. These tests were made in the 267 ml Hull cell using the following Zinc chloride bath.

| ACID ZINC CHLORIDE BATH | | |
|---|---|---|
| Zinc chloride | 0.5 normal | 70 g/l |
| Potassium chloride | 1.5 normal | 225 g/l |
| Boric Acid | 0.5 normal | 30 g/l |
| ph | 5.0 to 5.5 | |
| Temperature | 60° to 85° F | |

Plating tests were made with the above bath in the 267 ml Hull cell and plated at 2 amperes for 5 minutes. The combination of addition agents and their required concentrations to produce a uniform bright zinc deposit are shown in the following examples. The four aromatic carbonyl compounds that were evaluated were benzaldehyde, chloro benzaldehyde, hydroxy benzaldehyde and benzal acetone. Two equivalent fatty diamino carboxylates were evaluated. They were Tomah Chemical Co. Amphoteric L and Armstrong Chemical Accobetaine. Both wetting agents are made from cocoanut fatty acids condensed with amino propyldimethyl amine which is then carboxylated. Two different fatty imidazole sulfonates were used. The Miranol JS is octoic imidazole-N-propane sulfonate. The Ultravon WCA and Intravon WCA are stearyl benzimidazole sulfonates. The hydrotropes were selected from commercial cyclic alcohols, glycol ethers, and aromatic sulfonates that are not wetting agents. The various brightener systems are shown in the following examples.

EXAMPLE 1

2g/l Benzaldehyde
2g/l Stearyl benzimidazole Sulfonate (Ultravon WCA)
7 g/l Lauryl amido propylamino acetic acid (Amphoteric L)
12 g/l Potassium Xylene Sulfonate
Bright zinc deposit from 1 amp/sq.ft. to 100 amp/sq.ft.

EXAMPLE 2

2g/l Benzaldehyde
2 g/l Stearyl benzimidazole sulfonate (Ultravon WCA)
7 g/l Lauryl amido propylamino acetic acid (Amphoteric L)
15 g/l Potassium toluene sulfonate

EXAMPLE 3

2 g/l Benzaldehyde
2 g/l Stearyl benzimazole sulfonate (Intravon WCA)
7 g/l Lauryl amidopropyl amino acetic acid (Accobetaine)
17 g/l Sodium methyl napthalene sulfonate (Petro A)

EXAMPLE 4

2 g/l Benzaldehyde
2 g/l Stearyl benzimidazole sulfonate (Ultravon WCA)
7 g/l Lauryl amido propyl amino acetic acid (Amphoteric L)
16 g/l Diethylene glycol monobutyl ether (Dowanol EB)

EXAMPLE 5

2 g/l Benzaldehyde
2 g/l Stearyl benzimidazole sulfonate (Intravon WCA)
7 g/l Lauryl amido propyl amino acetic acid (Amphoteric L)
17 g/l Dipropylene glycol methyl ether (Dowanol EPM)

EXAMPLE 6

2 g/l Benzaldehyde
2 g/l Stearyl benzimidazole sulfonate (Intravon WCA)
7 g/l Lauryl amido proylamino acetic acid (Accobetaine)
18 g/l Tetrahydropyran - 2 methanol

EXAMPLE 7

2 g/l Benzaldehyde
2 g/l Stearyl benzimidazole sulfonate (Ultravon WCA)
7 g/l Lauryl amido propylamino acetic acid (Amphoteric L)
20 g/l Tetrahydrofurfural alcohol

EXAMPLE 8

2 g/l Benzaldehyde
2 g/l Stearyl benzimidazole sulfonate (Intravon WCA)
7 g/l Lauryl amido propyl amino acetic acid (Accobetaine)
21 g/l Cyclohexanol The brightening systems shown in Examples 1 to 8 inclusive all produce a bright zinc deposit throughout the whole current density range of from 1 amp/sq.ft. up to 100 amp/sq.ft. These eight examples illustrate the wide range of hydrotropic coupling agents that can be used in these baths. The ensuing Examples of brightening systems show the variations of the aromatic carbonyl brighteners and the variation of fatty diamino wetting agents with a fixed choice of a single hydrotrope.

EXAMPLE 9

1 g/l Benzylidene acetone (also called Benzal acetone)
2 g/l Steary benzimidazole sulfonate (Ultravon WCA)
3 g/l Octyl imidazole N propane sulfonate (Miranol JS)
12 g/l Potassium xylene sulfonate This bath has a bright plating range from 10 to 55 amp/sq.ft. and can be used in barrel plating.

EXAMPLE 10

1 g/l Ortho chlorobenzaldehyde
2 g/l Stearyl benzimidazole sulfonate (Intravon WCA)
7 g/l Lauryl amido propyl amino acetic acid (Amphoteric L)
12 g/l Potassium xylene sulfonate

EXAMPLE 11

1.5 g/l Benzaldehyde
7 g/l Lauryl amido propyl amino acetic acid (Accobetaine)
2 g/l Nicotinic acid This bath has a bright current density range from 10 to 60 amp./sq.ft. and can be used in barrel plating.

EXAMPLE 12

2 g/l Benzaldehyde
7 g/l Lauryl amido propyl amino acetic acid (Amphoteric L)
5 g/l Polyamine quaternary from U.S. Pat. No. 3,957,595 to DuBrow.

This bath has a bright current density range from 5 to 55 amperes/sq.ft. and can be used for barrel plating.

EXAMPLE 13

2 g/l Hydroxy Benzaldehyde
2 g/l Stearyl benzimidazole Sulfonate (Ultravon WCA)
7 g/l Lauryl amido propyl amino acetic acid (Amphoteric L)
15 g/l Potassium Xylene Sulfonate It can be seen that a wide variety of brightening systems for the acid zinc chloride bath can be obtained by the novel use of an aromatic aldehyde or ketone dispersed into the electrolyte by means of a combination of amphoteric fatty amino wetting agents and a hydrotrope selected from the cyclic alcohols, the glycol ethers and the aromatic sulfonates that are not wetting agents. However, we believe that the nature of the invention is described in the following claims:

What we claim is:

1. The method of electroplating a bright zinc deposit from an aqueous acid chloride electrolyte containing potassium chloride as the conducting salt and boric acid as the buffer; by means of an aromatic aldehyde or ketone brightener that is dispersed into the electrolyte by means of a mixture of, 1- a fatty imidazole sulfonate, 2- a fatty amido betaine and 3- a hydrotropic coupling agent selected from the group consiting of cyclic alcohols, glycol ethers and aromatic sulfonates that are not wetting agents.

2. The method of electroplating a bright zinc deposit from an aqueous acid zinc chloride electrolyte containing potassium chloride as the conducting salt and boric acid as the buffer; by means of an aromatic carbonyl compound selected from the group consisting of benzaldehyde, chlorobenzaldehyde and benzal acetone, said aromatic carbonyl compound being dispersed into the electrolyte by means of a mixture of 1- a fatty imidazole sulfonate 2- a fatty amido propyl dimethyl amino acetic acid and 3- a hydrotropic coupling agent selected from the group consisting of cyclic alcohols, glycol ethers, and aromatic sulfonates that are not wetting agents.

3. The method of electroplating a bright zinc deposit from an aqueous acid zinc chloride electrolyte according to claim 2 in which the aromatic carbonyl compound is 1 to 2 g/l of benzaldehyde; the fatty imidazole sulfonate is the heptadecyl benzimidazole sulfonate at 1 to 2 g/l and the fatty betaine is cocoa amido propyl dimethyl amino acetic acid at 5 to 15 g/l.

4. A mixture of addition agents that will produce a bright zinc deposit of an aqueous acid zinc chloride bath; said mixture consisting essentially of an aromatic aldehyde or ketone that is held in solution by means of a fatty imidazole sulfonate, a fatty amido betaine and a hydrotrope selected from the group consisting of cyclic alcohols, glycol ethers, and aromatic sulfonates that are not wetting agents.

5. The method of electroplating a bright zinc deposit from an aqueous acid zinc chloride electrolyte containing potassium chloride as the conducting salt and boric acid as the buffer; by means of an aromatic carbonyl brightening agent dispersed into the bath by a fatty diamino wetting agent augmented by a hydrotropic coupling agent selected from the group consisting of cyclic alcohols, glycol ethers, and aromatic sulfonates that are not wetting agents.

6. The method of electroplating a bright zinc deposit from an aqueous acid zinc chloride electrolyte containg potassium chloride as the conducting salt and boric acid as the buffer; by means of an aromatic carbonyl brightening agent dispersed into the bath by a fatty diamino wetting agent augmented by a hydroptropic coupling agent selected from the group consisting of cyclic alcohols, glycol ethers, and aromatic sulfonates that are not wetting agents assisted by the added brightening action of a nicotinic acid base as an auxiliary brightener.

7. The method of electroplating a bright zinc deposit from an aqueous acid zinc chloride electrolyte containing potassium chloride as the conducting salt and boric acid as the buffer; by means of an aromatic carbonyl brightening agent dispersed into the bath by a fatty diamino wetting agent augmented by a hydrotropic coupling agent selected from the group consisting of cyclic alcohols, glycol ethers, and aromatic sulfonates that are not wetting agents and assisted by the brightening action of a cationic polyamine polymer.

8. The method of electroplating a bright zinc deposit from an aqueous acid zinc chloride electrolyte; by means of an aromatic carbonyl brightening agent, said carbonyl compound being dispersed into the bath by means of a mixture of 1) a fatty imidazole sulfonate, 2) a fatty amidopropyl dimethyl amino acetic acid, and 3) a hydrotropic coupling agent selected from the group consisting of cyclic alcohols, glycol ethers, and aromatic sulfonates that are not wetting agents.

* * * * *